US010107098B2

(12) United States Patent
Sollami

(10) Patent No.: US 10,107,098 B2
(45) Date of Patent: Oct. 23, 2018

(54) BORE WEAR COMPENSATING BIT HOLDER AND BIT HOLDER BLOCK

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 199 days.

(21) Appl. No.: 15/070,262

(22) Filed: Mar. 15, 2016

(65) Prior Publication Data

US 2017/0268334 A1 Sep. 21, 2017

(51) Int. Cl.
*E21C 35/18* (2006.01)
*E21C 35/197* (2006.01)

(52) U.S. Cl.
CPC ..... *E21C 35/197* (2013.01)

(58) Field of Classification Search
CPC ..... E21C 35/18; E21C 35/19; E21C 35/197; E21C 2035/191
See application file for complete search history.

(56) References Cited

U.S. PATENT DOCUMENTS 3,397,012 A 8/1968 Krekeler
3,519,309 A 7/1970 Engle
3,865,437 A 2/1975 Crosby
4,084,856 A * 4/1978 Emmerich ..... E21C 35/197 175/354
4,247,150 A 1/1981 Wrulich et al.
4,310,939 A 1/1982 Iijima
4,489,986 A 12/1984 Dziak
4,525,178 A 6/1985 Hall
4,561,698 A 12/1985 Beebe
4,570,726 A 2/1986 Hall
4,603,911 A * 8/1986 Hindmarsh ..... E21C 35/197 299/104
4,604,106 A 8/1986 Hall
4,694,918 A 9/1987 Hall
4,763,956 A 8/1988 Emmerich
4,811,801 A 3/1989 Salesky
4,818,027 A * 4/1989 Simon ..... E21C 35/197 299/107
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
(Continued)

FOREIGN PATENT DOCUMENTS

DE 102004049710 4/2006
DE 102011079115 1/2013
(Continued)

*Primary Examiner* — John J Kreck
(74) *Attorney, Agent, or Firm* — Mercedes V. O'Connor; Rockman Videbeck & O'Connor

(57) ABSTRACT

A bit assembly includes a base block and a bit having a forward body portion and a shank. The bit includes a diametrically expanding retainer circumferentially disposed around a shank of the bit adapted to maintain the interference contact between the bit and the base block as the diameter of a bore of the base block increases from use. The bit assembly also includes a sealing gasket that forms a force fit between a washer disposed about the shank of the bit and the base block.

21 Claims, 10 Drawing Sheets

(56) References Cited

U.S. PATENT DOCUMENTS 5,098,167 A 3/1992 Latham
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,374,111 A 12/1994 Den Besten
5,415,462 A 5/1995 Massa
5,417,475 A 5/1995 Graham et al.
5,458,210 A 10/1995 Sollami
5,628,549 A 5/1997 Ritchey
5,725,283 A 3/1998 O'Neill
5,730,502 A * 3/1998 Montgomery, Jr. .. E21C 35/197 299/104
5,931,542 A * 8/1999 Britzke ..... E21C 35/197 299/104
5,992,405 A 11/1999 Sollami
D420,013 S 2/2000 Warren
6,102,486 A 8/2000 Briese
6,176,552 B1 1/2001 Topka, Jr.
6,357,832 B1 3/2002 Sollami
6,371,567 B1 4/2002 Sollami
6,508,516 B1 1/2003 Kammerer
D471,211 S 3/2003 Sollami
6,584,810 B2 7/2003 Montgomery
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,824,225 B2 11/2004 Stiffler
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
8,007,049 B2 8/2011 Fader
8,007,051 B2 8/2011 Hall
8,033,615 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
9,039,099 B2 5/2015 Sollami
2002/0167216 A1 11/2002 Sollami
2003/0015907 A1 1/2003 Sollami
2003/0047985 A1 3/2003 Stiffler
2003/0137185 A1* 7/2003 Sollami ..... E21C 35/197 299/106
2004/0004389 A1 1/2004 Latham
2004/0174065 A1 9/2004 Sollami
2006/0071538 A1 4/2006 Sollami
2006/0186724 A1 8/2006 Stehney
2008/0035386 A1 2/2008 Hall et al.
2008/0036271 A1* 2/2008 Hall ..... E21C 35/18 299/87.1
2009/0200857 A1 8/2009 Hall
2009/0261646 A1 10/2009 Ritchie et al.
2010/0253130 A1 10/2010 Sollami
2011/0006588 A1 1/2011 Monyak et al.
2011/0089747 A1 4/2011 Helsel
2011/0204703 A1 8/2011 Sollami
2011/0254350 A1 10/2011 Hall
2012/0027514 A1 2/2012 Hall
2012/0038203 A1 2/2012 Hall
2012/0248663 A1 10/2012 Hall
2012/0261977 A1 10/2012 Hall
2012/0286559 A1 11/2012 Sollami
2013/0169023 A1 7/2013 Monyak
2015/0028656 A1 1/2015 Sollami
2015/0240634 A1 8/2015 Sollami
2015/0285074 A1 10/2015 Sollami
2015/0292325 A1 10/2015 Sollami
2015/0308488 A1 10/2015 Kahl
2015/0315910 A1 11/2015 Sollami
2016/0194956 A1 7/2016 Sollami
2017/0089198 A1 3/2017 Sollami

FOREIGN PATENT DOCUMENTS

DE 202012100353 6/2013
DE 102015121953 7/2016
DE 102016118658 3/2017
WO 2008105915 A2 9/2008
WO 2008105915 A3 9/2008
WO 2009006612 1/2009

* cited by examiner

DETAIL B

DETAIL C

DETAIL MQ

DETAIL M

BORE WEAR COMPENSATING BIT HOLDER AND BIT HOLDER BLOCK

TECHNICAL FIELD

This disclosure relates to bit assemblies for road milling, mining, and trenching equipment.

BACKGROUND

Road milling, mining, and trenching equipment utilizes bit assemblies having a bit and a base block. A bit tip insert is retained by the bit and the bit is retained within a bore in the base block. A plurality of the bit assemblies are mounted on the outside of a rotatable drum, typically in a V-shaped or spiral configuration. The combinations of bit assemblies have been utilized to remove material from the terra firma, such as degrading the surface of the earth, minerals, cement, concrete, macadam or asphalt pavement. Individual bits and base blocks may wear down or break over time due to the harsh road degrading environment. Additionally, the forces and vibrations exerted on the bit assemblies may cause the bit to wear away the bore of the base block. As a result, the diameter of the bore of the base block increases over time, decreasing the interference contact between the bit and the bore of the base block, damaging the base block, and requiring replacement of the base block long before the standard minimum lifetime required by the industry. To prolong the life of the bit assembly, and the base block, a bit comprising a diametrically expanding retainer circumferentially disposed around the shank of the bit is provided to maintain the interference contact between the bit and the bore of the base block as the diameter of the bore of the base block increases from use.

SUMMARY

This disclosure relates generally to bit assemblies for road milling, mining, and trenching equipment. One implementation of the teachings herein is a bit that includes a bit body, a shank axially depending from the bit body, a retainer disposed circumferentially about the shank, and a washer disposed circumferentially about the shank. The retainer further includes a slot axially extending along a length of the retainer.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 1:
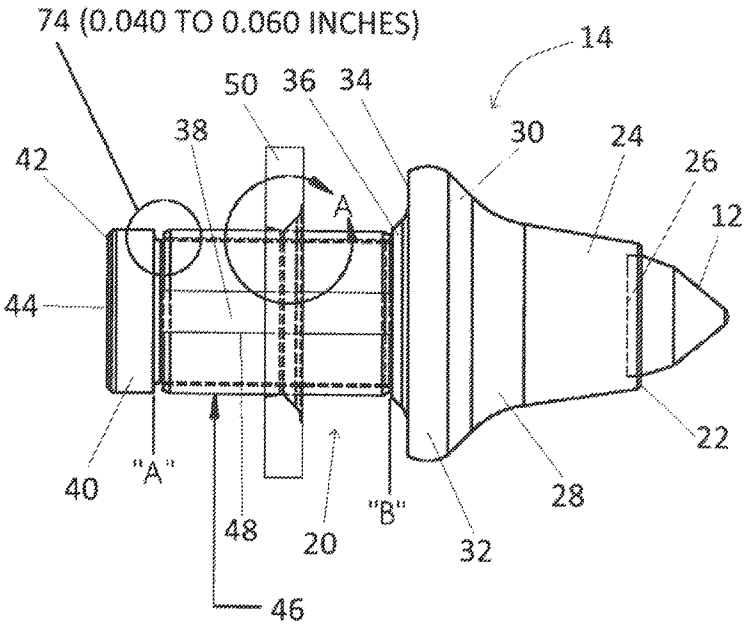
FIG. 1 is a side plan view of a bit, showing Area A.
Figure 2:
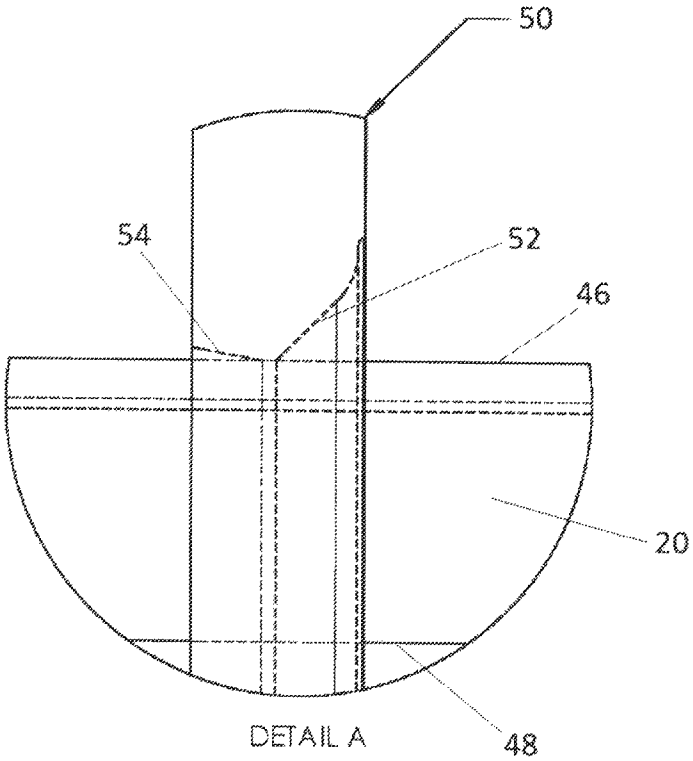
FIG. 2 is a detail side plan view of Area A of the bit of FIG. 1.
Figure 3:
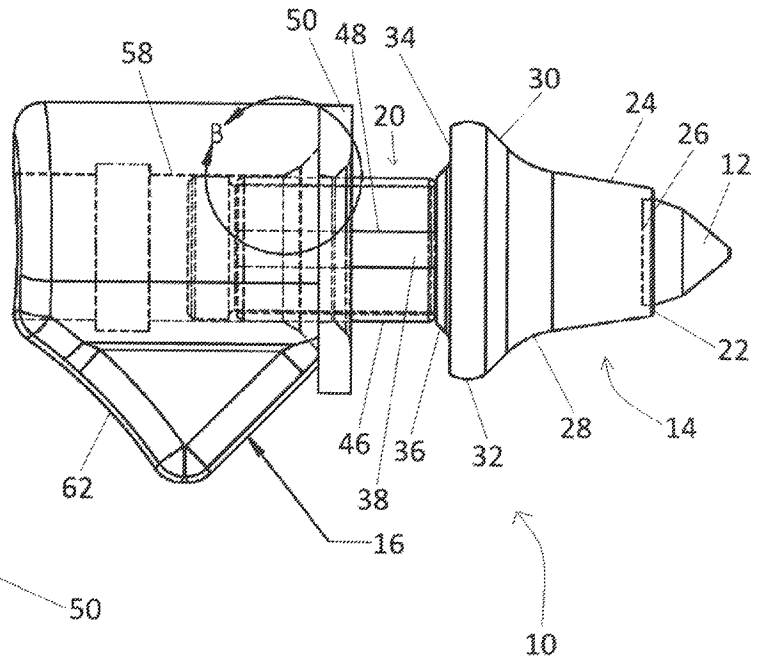
FIG. 3 is a side plan view of a bit assembly, showing Area B when the bit is initially inserted into a base block.
Figure 4:
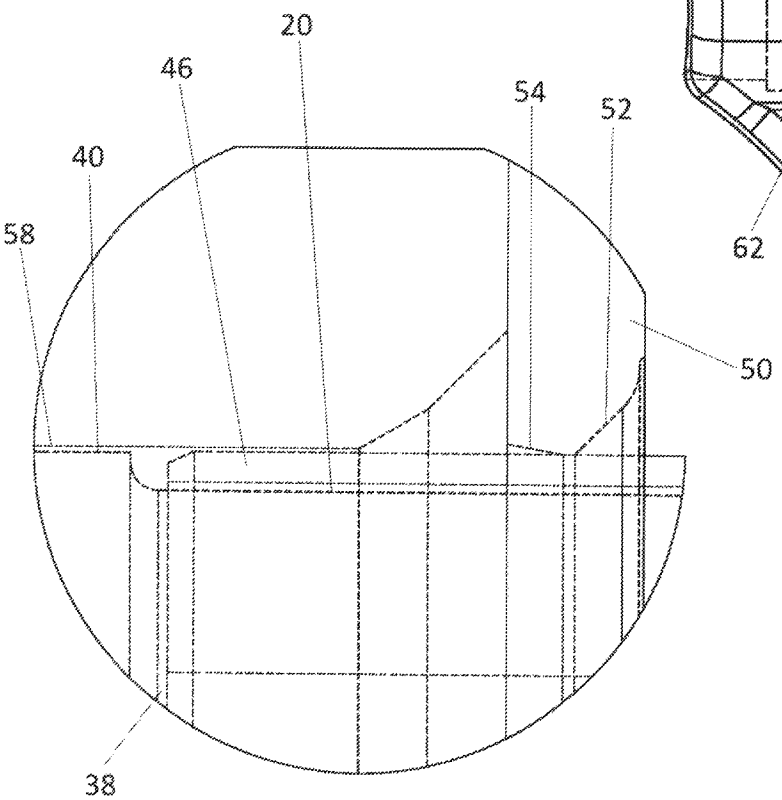
FIG. 4 is a detail side plan view of Area B of the bit assembly of FIG. 3.
Figure 5:
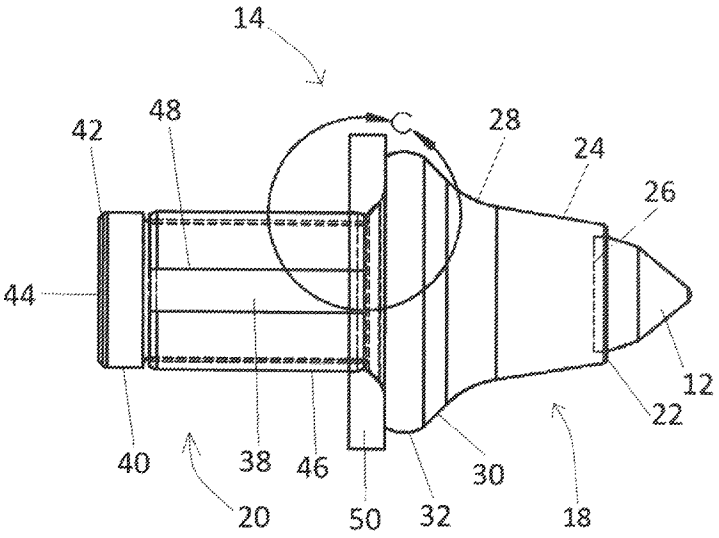
FIG. 5 is a side plan view of the bit, showing Area C.
Figure 6:
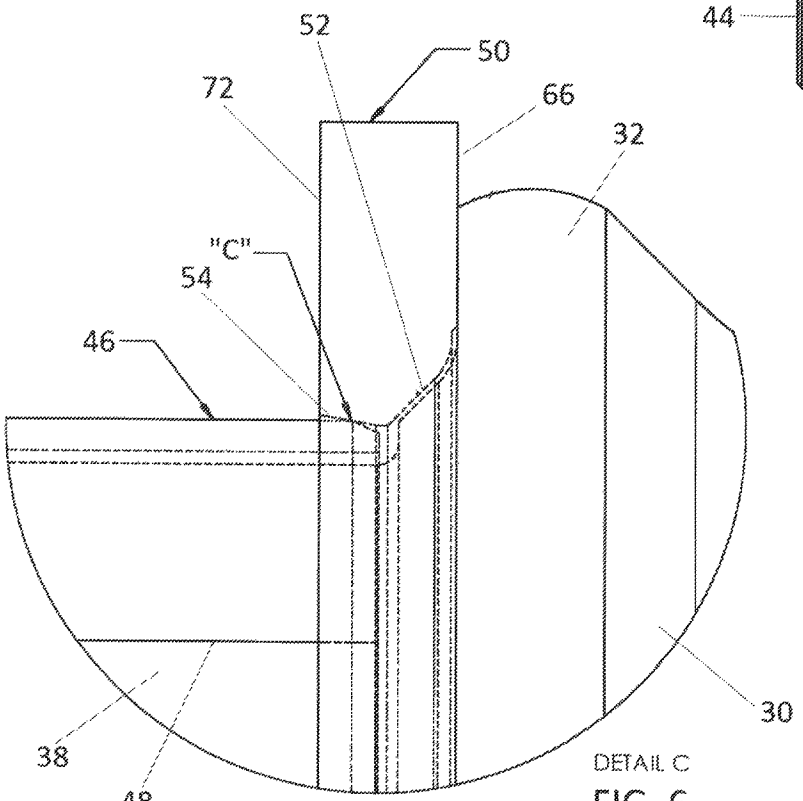
FIG. 6 is a detail plan view of Area C of the bit of FIG. 5.
Figure 7:
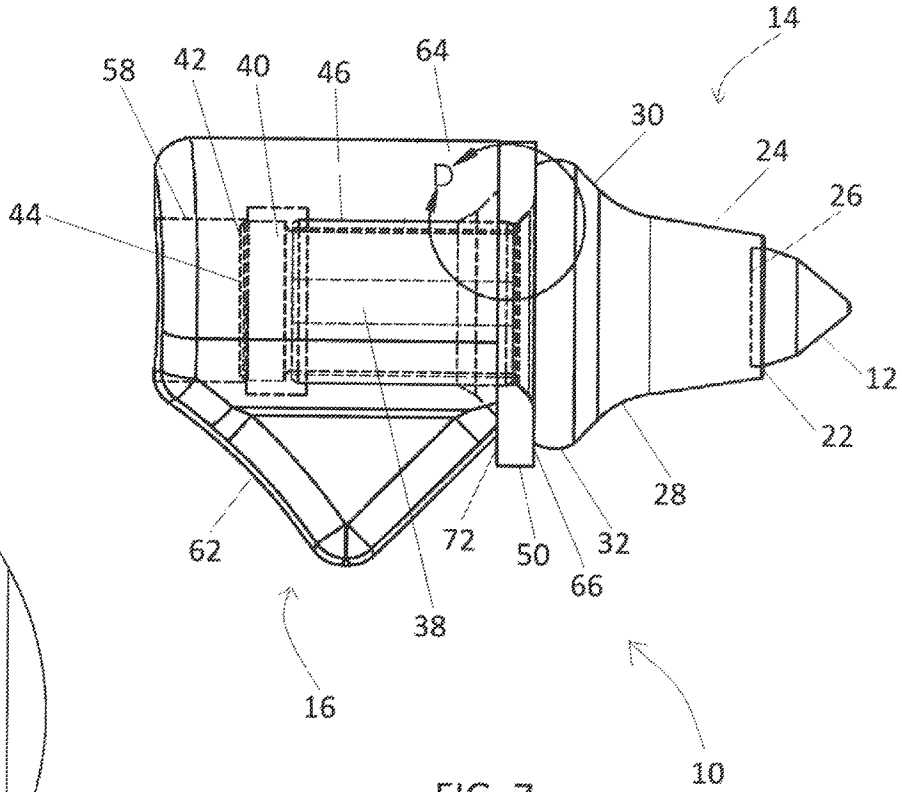
FIG. 7 is a side plan view of the bit assembly, showing Area D when the bit is completely inserted into the base block.
Figure 8:
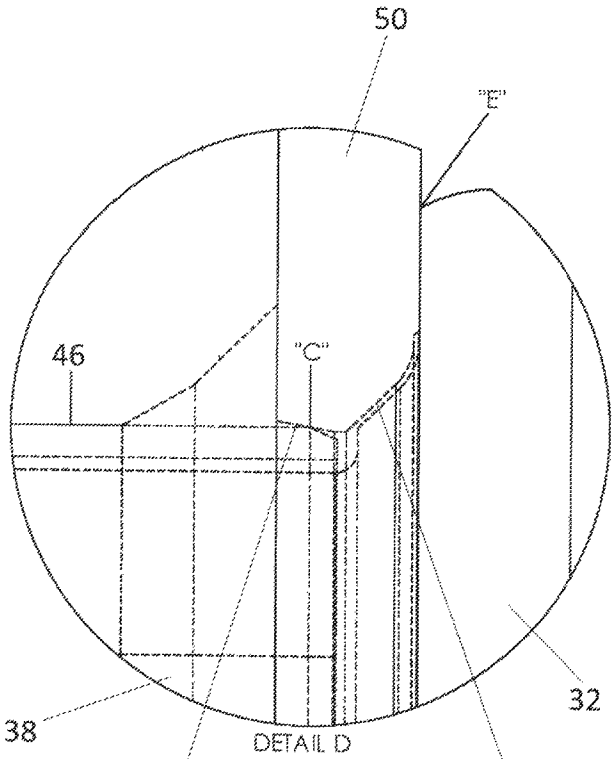
FIG. 8 is a detail plan view of Area D of the bit assembly of FIG. 7.

Road milling, mining, and trenching equipment utilizes bit assemblies having a bit, comprising a bit body and a shank, and a base block. A bit tip insert is retained by the bit and the shank of the bit is retained within a bore in the base block. The combinations of bit assemblies have been utilized to remove material from the terra firma, such as degrading the surface of the earth, minerals, cement, concrete, macadam or asphalt pavement. Individual bits and base blocks may wear down or break over time due to the harsh road degrading environment. Tungsten carbide and diamond or polycrystalline diamond coatings, which are much harder than steel, have been used to prolong the useful life of bits and bit assemblies. Base blocks are generally made of steel. Forces, vibrations, and loose abrasive materials exerted on the bit assemblies may cause the shank and the bit to wear away the bore of the base block. As a result, the diameter of the bore of the base block increases over time, decreasing, if not eliminating, the interference contact between the shank of the bit and the bore of the base block and damaging the base block. The damage to the base block may require replacement of the base block long before the standard minimum lifetime required by the industry. One important aspect of the present disclosure is to provide a bit, pick, or bit/holder combination comprising a diametrically expanding retainer circumferentially disposed around the shank of the bit adapted to maintain the interference contact between the bit and the base block as the diameter of the bore of the base block increases from use, thereby prolonging the life of the base block and the bit assembly. Another important aspect of the present disclosure is to provide a sealing gasket between a washer disposed about the shank of the bit and the base block, providing an additional force fit between the bit and base block.

Referring to FIGS. 3, 7, 9, 11, 13, 17, and 18, an illustrated embodiment of a bit assembly 10 comprises a bit tip insert 12, a bit 14, and a base block 16. The bit 14 includes a bit body 18 and a shank 20 axially depending from the bottom of the bit body 18. The bit body 18 is generally annular in shape and comprises a flat annular top surface 22 adjacent to an upper body portion 24 that includes an annular trough 26 in which to retain the bit tip insert 12. The upper body portion 24 generally slopes axially and radially outwardly to an arcuate first mediate portion 28. The first mediate portion 28 generally slopes axially and radially outwardly to a second mediate portion 30. The second mediate portion 30 generally slopes axially and radially outwardly to a radially extending generally arcuate tire portion 32. A decreased diameter tapered distal portion 36 extends from a flange 34, such as a flat annular flange, subjacent to the tire portion 32.

The shank 20, shown in FIGS. 1, 3, 5, 7, 9, 11, 13, 17, and 18, axially depends from the decreased diameter tapered distal portion 36 of the bit body 18. The bit body 18 and the shank 20 are coaxial. The shank 20 comprises a generally cylindrical decreased diameter upper segment 38 that axially extends from the decreased diameter tapered distal portion 36 and a generally cylindrical increased diameter lower segment 40. Subjacent the lower segment 40 is a decreased diameter distal segment 42 that axially extends from the lower segment 40 to a distal end 44 of the shank 20. In other embodiments, the shank 20 can be cylindrical or can include tapered and arcuate segments.

Figure 16B:
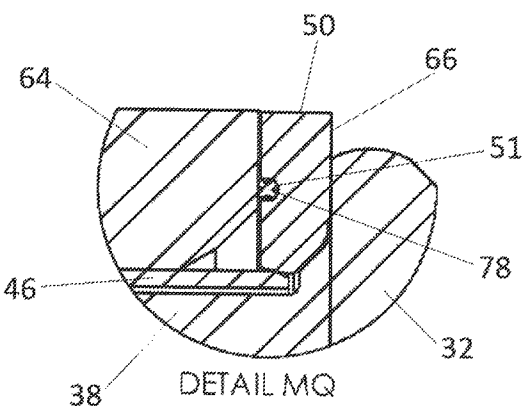
FIG. 16B is a detail cross-sectional view of Area M of the bit assembly of FIG. 15, showing a quad-ring gasket.
Figure 16A:
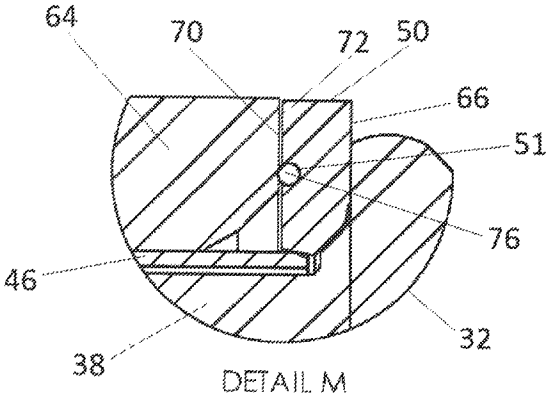
FIG. 16A is a detail cross-sectional view of Area M of the bit assembly of FIG. 15, showing an o-ring gasket.
Figure 17:
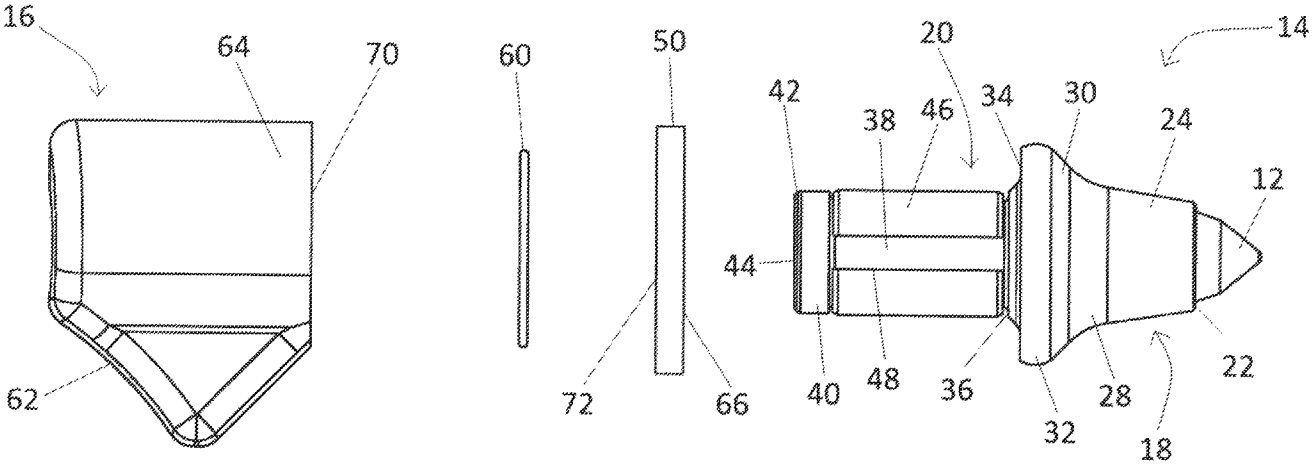
FIG. 17 is an exploded side elevation view of the bit assembly of FIG. 15.
Figure 19:
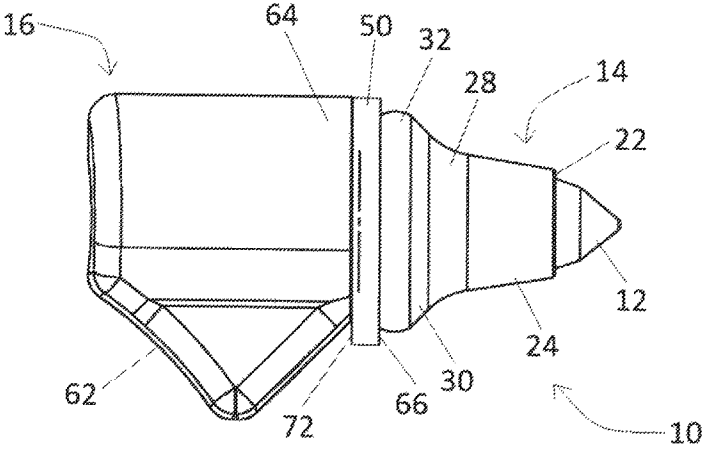
FIG. 19 is a side elevation view of the bit assembly of FIG. 15.
Figure 18:
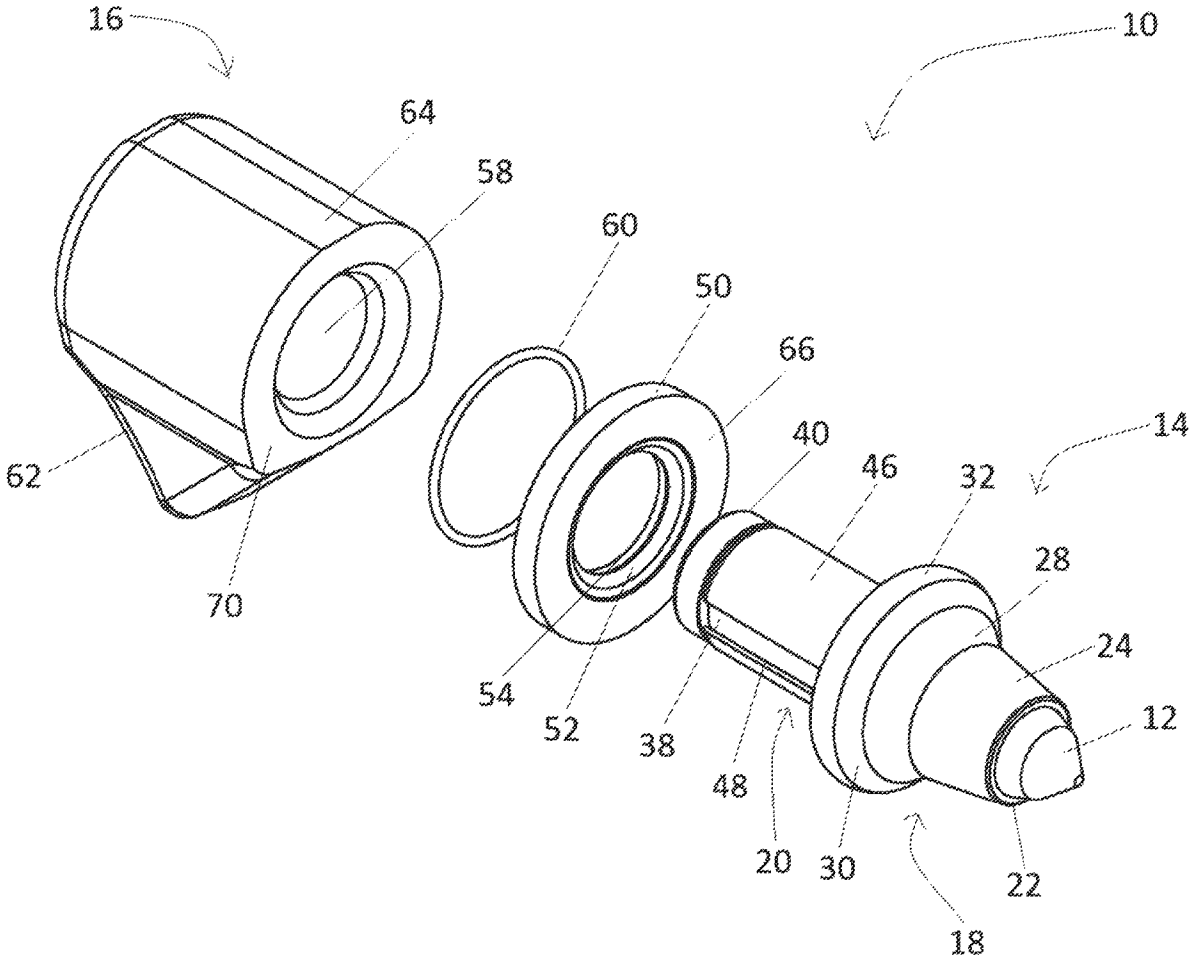
FIG. 18 is an exploded perspective view of the bit assembly of FIG. 15.

The shank 20 includes a coaxial and generally cylindrical collapsible retainer 46, shown in FIGS. 1-14 and 16-18, that is disposed circumferentially about the shank 20. The retainer 46 is generally made from spring steel or other hardenable material with an elasticity that allows the retainer 46 to return to its original shape despite significant deflection or twisting. The axial length of the retainer 46 is shorter than the axial length of the shank 20 between point "A" and point "B," as shown in FIG. 1. In the embodiment of FIG. 1, the typical difference 74 between the retainer 46 length and the shank 20 axial length between point "A" and point "B" is in the range of approximately 0.040 to 0.060 inches, however, the typical difference 74 between point "A" and point "B" may be varied depending on the applicable circumstances. The retainer 46 includes a slot 48 that axially extends along the length of the retainer 46. A washer 50 is disposed circumferentially about the retainer 46 and the shank 20. The washer 50 includes a first inner portion 52 and a second inner portion 54, shown in FIGS. 2, 4, 6, 8, 10, 12, 14, and 18, where the first inner portion 52 is adjacent the second inner portion 54. The first inner portion 52 is tapered to comprise the same dimensions as the dimensions of the decreased diameter tapered distal portion 36. The second inner portion 54 comprises a reverse taper such that the angle of the reverse taper is adapted to urge the washer 50 forward when an interference contact is formed between the retainer 46 and the base block 16. In an alternate embodiment, the washer 50 includes an annular sealing gasket 60, shown in FIGS. 17 and 18, disposed in a groove 51, shown in FIGS. 16A and 16B, on a rear face 72 of the washer 50 that is adapted to contact and form a seal with a forward face 70 of the base block 16, thereby providing a force fit between the washer 50 and the base block 16. The sealing gasket 60 can be an o-ring gasket 76, shown in FIG. 16A, a quad-ring gasket 78, shown in FIG. 16B, or similar sealing gasket, gasket seal, or gasket forming a seal.

The base block 16, shown in FIGS. 3, 7, 9, 11, 13, 15, and 17-19, comprises a base 62 and a front end 64. The base 62 can be flat or slightly concave to fit a drum or additional mounting plates on which a plurality of base blocks can be mounted. The front end 64 includes a base block bore 58, shown in FIG. 18, that is symmetrical with the shank 20 along a centerline. The base block bore 58 can be machined in a precision manner or other similar manner.

When assembled, slot 48 allows the retainer 46 to radially compress when inserted into the base block bore 58 of the front end 64, forming an interference contact between the retainer 46, the shank 20, and the base block bore 58. The force between the diametrically contracted retainer 46 and the base block bore 58 maintains and retains the bit 14 in the base block 16. The bit 14 and the base block 16 are assembled together to form the bit assembly 10. When assembled, the sealing gasket 60 forms a seal between the washer 50 and the front end 64 of the base block 16, as shown in Detail H of FIGS. 16A and 16B. The bit body 18, shank 20, front end 64, and base block bore 58 of base block 16 are axially aligned when assembled together to form the bit assembly 10. The diameter of the retainer 46 matches the inner diameter of the base block bore 58 until the base block 16 needs to be replaced.

Figure 10:
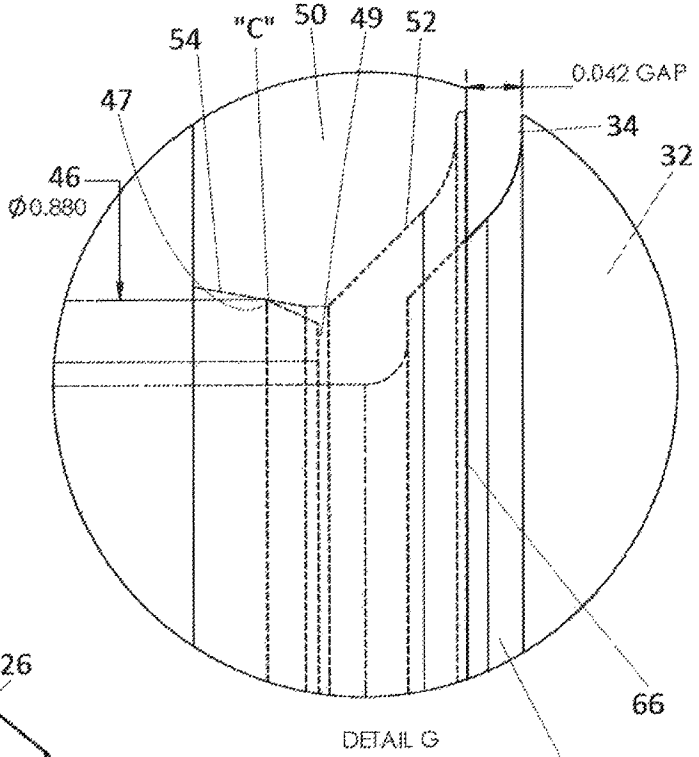
FIG. 10 is a detail plan view of Area G of the bit assembly of FIG. 9.

Over time, the forces, vibrations, and loose abrasive materials exerted on the bit assembly 10 through road milling, mining, and trenching operations wear away at the bit 14 and the base block bore 58, increasing the diameter of the base block bore 58. Bits 14 are typically replaced every 1-2 days. Each time a new bit 14 is driven into the base block bore 58, the washer 50 is driven into the forward face 70 of the base block 16. Since the length of the retainer 46 is less than the length of the shank 20 between point "A" and point "B," there will be some axial movement of the retainer 46 based on the angle of the second inner portion 54 of the washer 50, allowing a location 47 adjacent a forward end 49 of the retainer 46 to contact the second inner portion 54 of the washer 50 at contact point "C," as shown in FIG. 10.

To prolong the life of the base block 16, the retainer 46 is expanded to match the diameter 68 of the base block bore 58. As the diameter 68, shown in FIGS. 11 and 13, of the base block bore 58 increases due to bore wear, the retainer 46 begins to decompress moving outwardly diametrically towards the washer 50 where the location 47 of the retainer 46 makes contact at point "C" of the second inner portion 54 and urges the washer 50 to move toward point "E," shown in FIG. 8, thereby reducing the space between the contact at point "C" and point "A" and increasing the diameter of the retainer 46 to match the diameter 68 of the base block bore 58. When the diameter of the retainer 46 matches the diameter 68 of the base block bore 58, an interference contact is again formed between the retainer 46 and the base block bore 58, and the washer 50 is in turn urged forward towards the bit body 18. As the retainer 46 is further expanded and the washer 50 is further urged forward, the contact at point "C" is moved towards the rear face 72 of the washer 50, as shown sequentially in FIGS. 10, 12, and 14. As the angle of the reverse taper of the second inner portion 54 is decreased or increased, an increase or decrease, respectively, also occurs with the axial movement of the washer 50. Eventually, all space between point "A" and point "E" will be eliminated, thereby eliminating the distance between a forward face 66 of the washer 50 and the flange 34 of the bit body 18.

Figure 9:
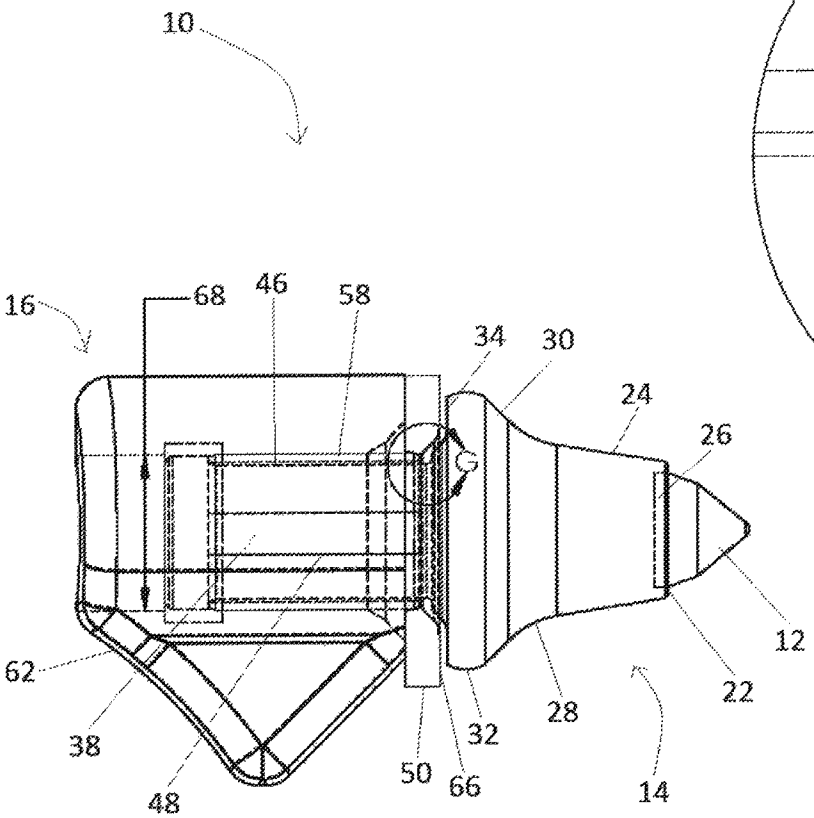
FIG. 9 is a side plan view of the bit assembly, showing Area G when the bit is disposed within a new base block.

For illustration purposes, the bit assembly 10 is shown at three stages of the life time of the base block 16. FIGS. 9 and 10 show a new base block 16 in bit assembly 10. In the illustrated embodiment, when the base block 16 is new, the diameter 68 of the base block bore 58 is a nominal 0.880 inches, however, the diameter 68 may be varied depending on the applicable circumstances. In this illustrated embodiment, the initial diameter of the retainer 46 is in the range of approximately 0.935-0.960 inches, however, the diameter of the retainer 46 may also be varied depending of the applicable circumstances. The diameter of the retainer 46 is then pre-compressed to a diameter smaller than the diameter 68 of the base block bore 58 to allow manual pre-insertion of the shank 20 into the base block bore 58. The diameter of the retainer 46 is thereby collapsed to 0.880 inches to match the diameter 68 of the base block bore 58 when the bit 14 is initially installed in the base block 16. The gap between the forward face 66 of the washer 50 and the flange 34 of the bit body 18 is approximately 0.042 inches, as shown by Detail G in FIG. 10, when the base block 16 is new.

Figure 12:
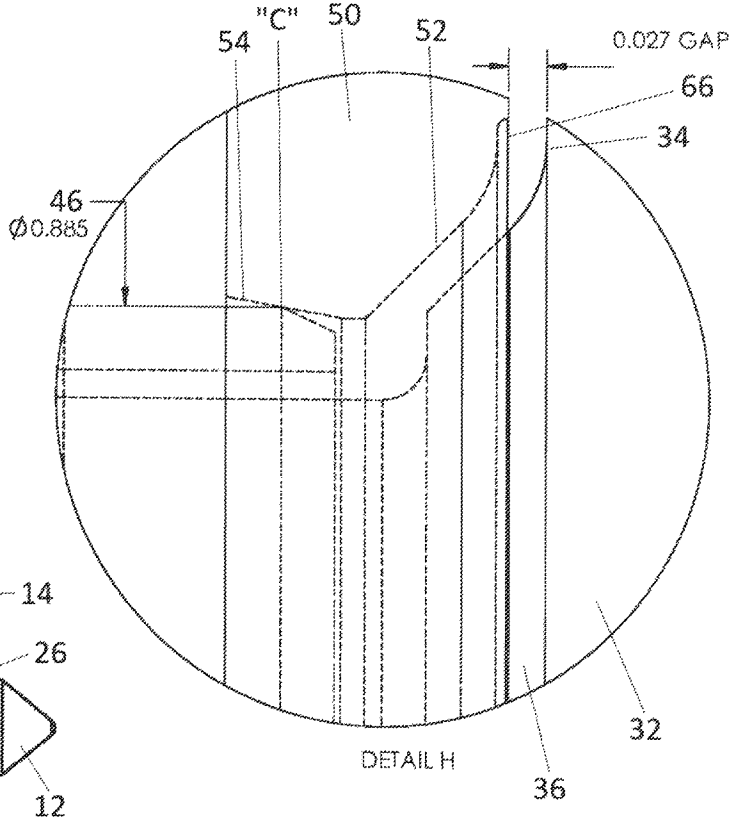
FIG. 12 is a detail plan view of Area H of the bit assembly of FIG. 11.
Figure 11:
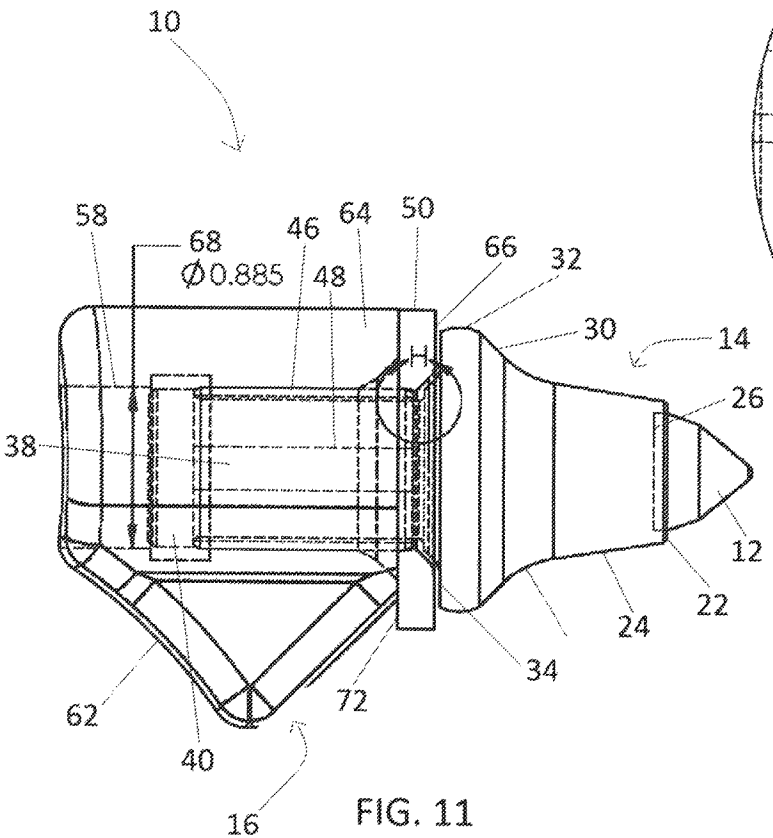
FIG. 11 is a side plan view of the bit assembly, showing Area H when the base block is worn approximately 0.005 inches.

In the illustrated embodiment, FIGS. 11 and 12 show the base block 16 in bit assembly 10 when the base block bore 58 is worn approximately 0.005 inches. When the base block bore 58 is worn approximately 0.005 inches, the diameter 68 of the base block bore 58 is approximately 0.885 inches. As the forces and vibrations exerted on the bit assembly 10 when it is in use increase the diameter 68 of the bore 58, the retainer 46 will again begin to further decompress. Since the retainer 46 is axially moveable between point "A" and point "B," based on the angle of the second inner portion 54 of the washer 50, the location 47 of the retainer 46 will then make contact with a new point "C," shown in FIG. 12, which will force the forward face 66 of the washer 50 towards the flange 34 of the bit body 18. The diameter of the retainer 46 expands to 0.885 inches to match the diameter 68 of the base block bore 58, forming an interference contact between the retainer 46 and the base block bore 58. Once the interference contact is formed, the retainer 46 and base block 16 will force the washer 50 to move towards the bit body 18, decreasing the gap between the forward face 66 of the washer 50 and the flange 34 of the bit 14. The gap between the forward face 66 of the washer 50 and the flange 34 of the bit body 18 is then reduced to approximately 0.027 inches, as shown by Detail H in FIG. 12, when the base block bore 58 is worn approximately 0.005 inches.

Figure 14:
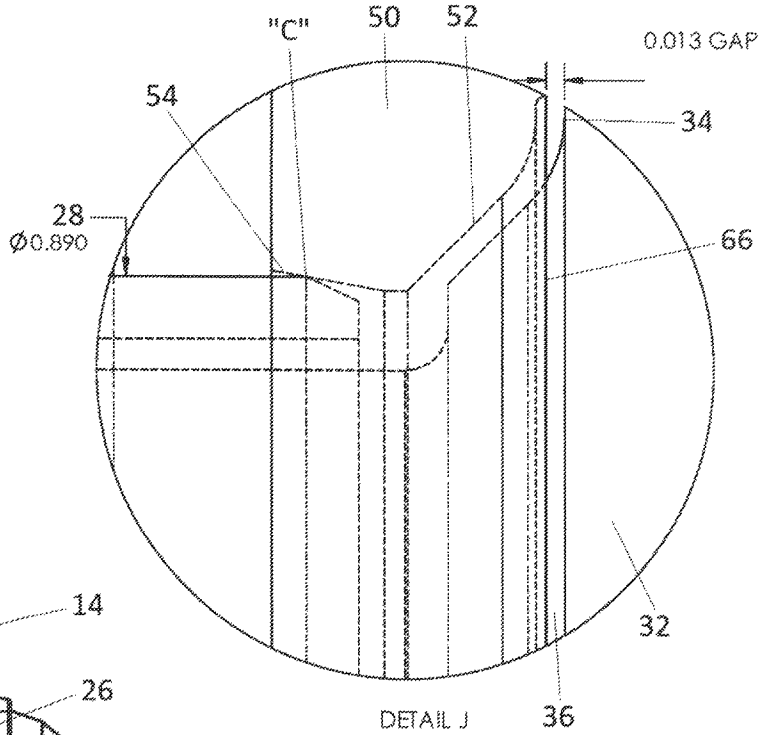
FIG. 14 is a detail plan view of Area J of the bit assembly of FIG. 13.
Figure 13:
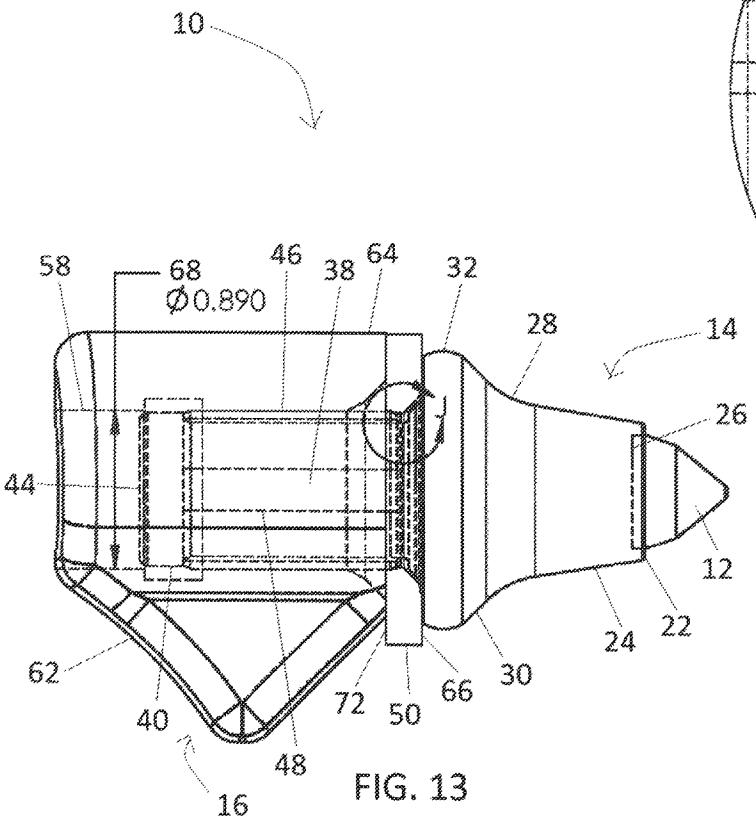
FIG. 13 is a side plan view of the bit assembly, showing Area J when the base block is worn approximately 0.010 inches.
Figure 15:
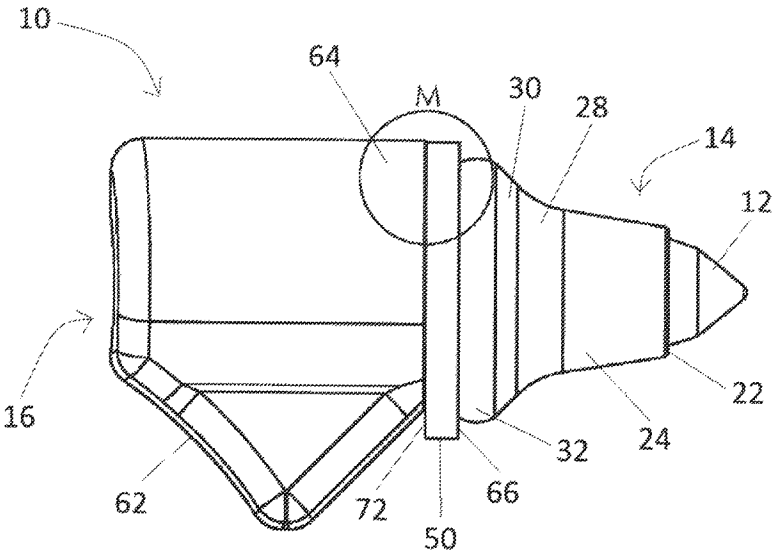
FIG. 15 is a side elevation view of the bit assembly, showing Area M.

In the illustrated embodiment, FIGS. 13 and 14 show the base block 16 in bit assembly 10 when the base block bore 58 is worn approximately 0.010 inches. When the base block bore 58 is worn approximately 0.010 inches, the diameter 68 of the base block bore 58 is approximately 0.890 inches. As the forces and vibrations exerted on the bit assembly 10 when it is in use increase the diameter 68 of the bore 58, the retainer 46 will again begin to further decompress. Since the retainer 46 is axially moveable between point "A" and point "B," based on the angle of the second inner portion 54 of the washer 50, the location 47 of the retainer 46 will then make contact with a new point "C," shown in FIG. 14, which will force forward face 66 of the washer 50 towards the flange 34 of the bit body 18. The diameter of the retainer 46 expands to 0.890 inches to match the diameter 68 of the base block bore 58 forming an interference contact between the retainer 46 and the base block bore 58. Once the interference contact is formed, the retainer 46 and base block 16 will force the washer 50 to move towards the bit body 18, decreasing the gap between the forward face 66 of the washer 50 and the flange 34 of the bit 14. The gap between the forward face 66 of the washer 50 and the flange 34 of the bit body 18 is then reduced to approximately 0.013 inches, as shown by Detail J in FIG. 14, when the base block bore 58 is worn approximately 0.010 inches.

As the diameter 68 of the base block bore 58 increases, the retainer 46 decompresses to match the increased diameter 68 of the base block bore 58 and the location 47 of the retainer 46 makes contact with contact point "C", causing the retainer 46 to reform an interference contact between the retainer 46 and the base block 16 and causing forward face 66 of the washer 50 to move towards the flange 34 of the bit body 18. The process continues until the gap between the forward face 66 of the washer 50 is eliminated and varies depending on the size of the shank 20. When the base block bore 58 is worn beyond this point, and the diameter of the retainer 46 can no longer expand, the base block 16 must be replaced.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit comprising:

a bit body;

a shank axially depending from the bit body;

a retainer disposed circumferentially about the shank, the retainer comprising a slot axially extending along a length of the retainer; and a washer disposed circumferentially about the shank, the washer comprising an aperture including a first portion, a second portion, and a third portion disposed between the first portion and the second portion, the first portion tapered axially inwardly from a front face of the washer towards the third portion and the second portion tapered axially outwardly from the third portion to a rear face of the washer, the washer adapted to engage a location adjacent a forward end of the retainer.

2. A bit comprising:

a bit body;

a shank axially depending from the bit body;

a retainer disposed circumferentially about the shank, the retainer comprising a slot axially extending along a length of the retainer;

a washer disposed circumferentially about the shank, the washer adapted to engage a location adjacent a forward end of the retainer; and a sealing gasket disposed circumferentially about the shank, the sealing gasket adapted to form a seal between the washer and a base block.

3. The bit of claim 2, wherein the sealing gasket is one of an o-ring or a quad-ring.

4. A bit comprising:

a bit body;

a shank axially depending from the bit body;

a retainer disposed circumferentially about the shank, the retainer comprising a slot axially extending along a length of the retainer;

a washer disposed circumferentially about the shank;

an annular groove on a rear face of the washer; and a sealing gasket disposed in the annular groove, the sealing gasket adapted to form a seal between the washer and a base block.

5. The bit of claim 4, wherein the sealing gasket is one of an o-ring or a quad-ring.

6. The bit of claim 1, an angle of the second portion adapted to contact the location adjacent the forward end of the retainer when a diameter of the retainer radially expands to at least a diameter of the bore of the base block to form an interference fit between the retainer and the bore of the base block and move the washer toward a bottom of the bit body.

7. The bit of claim 1, wherein the shank comprises an upper segment and a lower segment, a first axial length of the retainer shorter than a second axial length of the upper segment.

8. The bit of claim 1, wherein a diameter of the retainer is initially at least 0.935 inch.

9. A combination bit and base block comprising:
the bit comprising:
a bit body;
a shank axially depending from the bit body;
a retainer disposed circumferentially about the shank, the retainer comprising a slot axially extending along a length of the retainer; and
a washer disposed circumferentially about the shank, the washer comprising an aperture including a first portion, a second portion, and a third portion disposed between the first portion and the second portion, the first portion tapered axially inwardly from a front face of the washer towards the third portion and the second portion tapered axially outwardly from the third portion to a rear face of the washer, the washer adapted to engage a location adjacent a forward end of the retainer; and
the base block comprising a bore adapted to make an interference contact with the retainer of the bit.

10. A combination bit and base block comprising:
the bit comprising:
a bit body;
a shank axially depending from the bit body;
a retainer disposed circumferentially about the shank, the retainer comprising a slot axially extending along a length of the retainer; and
a washer disposed circumferentially about the shank, the washer adapted to engage a location adjacent a forward end of the retainer;
the base block comprising a bore adapted to make an interference contact with the retainer of the bit; and
a sealing gasket disposed circumferentially about the shank, the sealing gasket adapted to form a seal between the washer and the base block.

11. The combination bit and base block of claim 10, wherein the sealing gasket is one of an o-ring or a quad-ring.

12. The combination bit and base block of claim 9, the second portion adjacent the rear face of the washer, the second portion adapted to contact the location adjacent the forward end of the retainer when a diameter of the retainer radially expands to at least a diameter of the bore of the base block to form an interference fit between the retainer and the bore of the base block and move the washer toward a bottom of the bit body.

13. A combination bit and base block comprising:
the bit comprising:
a bit body;
a shank axially depending from the bit body;
a retainer disposed circumferentially about the shank, the retainer comprising a slot axially extending along a length of the retainer;
a washer disposed circumferentially about the shank;
an annular groove on a rear face of the washer; and
a sealing gasket disposed in the annular groove, the sealing gasket adapted to form a seal between the washer and the base block; and
the base block comprising a bore adapted to make an interference contact with the retainer of the bit.

14. The combination bit and base block of claim 13, wherein the sealing gasket is one of an o-ring or a quad-ring.

15. The combination bit and base block of claim 9, an angle of the second portion adapted to contact the location adjacent the forward end of the retainer when a diameter of the retainer radially expands to at least a diameter of the bore of the base block to form an interference fit between the retainer and the bore of the base block and move the washer toward a bottom of the bit body.

16. The combination bit and base block of claim 9, wherein a diameter of the retainer is adapted to expand to an inner diameter of the bore to form the interference contact between the retainer and the bore of the base block.

17. The combination bit and base block of claim 16, wherein a distance between the washer and an annular flange of the bit body is adapted to decrease as the diameter of the retainer increases.

18. The combination bit and base block of claim 9, wherein the shank comprises an upper segment and a lower segment, a first axial length of the retainer shorter than a second axial length of the upper segment.

19. The combination bit and base block of claim 9, wherein a diameter of the retainer is initially at least 0.935 inch.

20. The combination bit and base block of claim 9, wherein an inner diameter of the bore of the base block is a nominal 0.880 inch.

21. A combination bit and base block comprising:
the bit comprising:
a bit body;
a shank axially depending from the bit body;
a retainer disposed circumferentially about the shank, the retainer comprising a slot axially extending along a length of the retainer; and
a washer disposed circumferentially about the shank, wherein an aperture of the washer includes a first tapered portion adjacent a second tapered portion; and
the base block comprising a bore adapted to make an interference contact with the retainer of the bit, wherein an enlargement of the base block bore allows the retainer outer diameter to enlarge and a leading tapered surface of the retainer impinging on the second tapered surface of the washer moves the washer towards the bit body.

* * * * *